US007209697B2

(12) United States Patent
Yoshida et al.

(10) Patent No.: US 7,209,697 B2
(45) Date of Patent: Apr. 24, 2007

(54) FUSING DEVICE HAVING A PRESSURE MEMBER, PUSHING MEMBER FUSING BELT AND ROLLER

(75) Inventors: Tatsuho Yoshida, Tokyo (JP); Noboru Oishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/053,868

(22) Filed: Feb. 10, 2005

(65) Prior Publication Data

US 2005/0191097 A1 Sep. 1, 2005

(30) Foreign Application Priority Data

Feb. 27, 2004 (JP) ..... 2004-053576

(51) Int. Cl.
*G03G 15/20* (2006.01)

(52) U.S. Cl. ..... 399/329

(58) Field of Classification Search ..... None
See application file for complete search history.

(56) References Cited

U.S. PATENT DOCUMENTS 5,873,020 A * 2/1999 Matsuura et al. ..... 399/329
6,795,678 B2 * 9/2004 Yura et al. ..... 399/329
2005/0078990 A1 * 4/2005 Shiraishi ..... 399/329

FOREIGN PATENT DOCUMENTS

JP 11-282293 10/1999

* cited by examiner

*Primary Examiner*—Quana Grainger
(74) *Attorney, Agent, or Firm*—Rabin & Berdo, PC

(57) ABSTRACT

To prevent a defective fusing from occurring, a fusing member has a roller; a fusing belt heated and rendered to drive along a circumference of the roller; a pressure member disposed outside the fusing belt and rendered in pressurized contact with the roller through the fusing belt; and a pushing member disposed inside the fusing belt, as arranged together with and at an upstream side from the roller in a driving direction of the fusing belt, and rendered in pressurized contact with the pressure member through the fusing belt. The fusing belt and the pressure member compose a contact area for allowing a recording medium to pass through. The pushing member is disposed inside the fusing belt as arranged together with and on an upstream side with respect to the roller in a driving direction of the fusing belt, so that the contact becomes wider.

13 Claims, 10 Drawing Sheets

FUSING DEVICE HAVING A PRESSURE MEMBER, PUSHING MEMBER FUSING BELT AND ROLLER

BACKGROUND OF THE INVENTION

1. Field of the Invention

This invention relates to a fusing device.

2. Description of Related Art

A fusing device in an image forming apparatus such as, e.g., a printer, a photocopier, a printing apparatus, or the like, for example, a fusing device of a printer, conventionally has a fusing roller installed inside with a heating source, and a pressure roller driven to rotate in pressurized contact with the fusing roller, and in such a fusing device, a sheet carrying a toner image not yet fused is transmitted to a nipping area formed between the fusing roller and the pressure roller to fuse the toner image onto the sheet at the nipping area.

Where the fusing device of this heating roller type is applied to a multicolor printer, a predetermined thermal amount is required to fuse the toner image, and because the toner images in multiple colors need to be overlaid on the sheet to form the multicolored image, a required thermal amount undesirably increases by that much. Furthermore, where the fusing device of the heating roller type is applied to a high speed printer, since the toner image is fused at a high speed, a required thermal amount per unit time further increases compared with a case where the toner image is fused at a low speed.

The thermal amount required for fusing toner image is generally determined by a power (watt=the thermal amount/time) of the heating source at the nipping area as well as each factor such as a nipping width and duration of pressurized contact. Therefore, to increase the thermal amount given to the toner image, it is required to increase the power of the heating source, to widen the nipping width, or to lengthen the duration of pressurized contact. Furthermore, to fuse the toner image at high speed, it is required to increase the power of the heating source or to widen the nipping width by an amount corresponding to shortening of time.

To increase the power of the heating source, it is required to enhance thermal resistance of constructional components of the fusing device or to reduce power consumption thereof, and when the multicolored toner images are fused at high speed, it becomes important to widen the nipping width.

To fuse the multicolored images at a high speed, a fusing device of a belt type has been provided in which a fusing belt is used to wide the nipping width (ref., e.g., Japanese Patent Application Publication No. JA-H11-282,293).

FIG. 2 is a cross-sectional view showing a conventional fusing device of a belt type, and FIG. 3 is a cross-sectional view of a conventional fusing belt.

In FIG. 2, numeral 11 is a heating roller rendered to rotate in a direction of arrow H; numeral 13 is a fusing belt; numeral 14 is a fusing roller rendered to rotate in a direction of arrow G; and numeral 15 is a pressure roller rendered to rotate in an direction of arrow K The fusing belt 13 is arranged as tensioned between the heating roller 11 and the fusing roller 14, and driven in a direction of arrow J. The pressure roller 15 is urged with a spring 19 and made in pressurized contact with the fusing roller 14 through the fusing belt 13, and a prescribed nipping area n is formed between the fusing belt 13 and the pressure roller 15. A sheet 22 is conveyed in a direction of arrow S, transmitted to the nipping area n, and nipped between the fusing roller 14 and the pressure roller 15 through the fusing belt 13 at the nipping area n. The heating roller 11 is urged with a spring 21 in the direction opposite to the fusing roller 14 to render the fusing belt 13 tensioned.

The heating roller 11 has inside a heater 12 such as, e.g., a halogen lamp and heats the fusing belt 13. To heat the fusing belt 13 effectively, the heating roller 11 is formed of a metal having a high thermal conductivity, such as, e.g., aluminum, iron, or the like.

The fusing belt 13 provides the heat received through the heating roller 11 for the toner image 20 at the nipping area n, thereby fusing the toner image 20 formed on the sheet 22 onto the sheet 22.

As shown in FIG. 3, the fusing belt 13 is composed of an external layer 13*a*, an intermediate layer 13*b*, and an internal layer 13*c*, in which the external layer 13*a* is made of a resin having a high mold releasing property, such as, e.g., a perfluoroalkylvinylether copolymer resin (hereinafter referred to as a "PFA"), and suppresses adherence of toners to the fusing belt 13. Furthermore, the intermediate layer 13*b* is made of a resin having an elasticity, such as, e.g., silicone rubber, while the internal layer 13*c* is made of material having a rigidity as well as a thermal resistance, such as a metal, e.g., nickel, stainless steel, etc., or such as a resin, e.g., polyimide, etc. and is thinned to obtain flexibility, for example, to have a thickness of 30 to 50 microns in a case of a metal or to have a 50 to 100 microns in a case of a resin.

The fusing roller 14 is provided with a core metal 14*b* made of a metal such as, e.g., aluminum, iron, or the like, and an elastic layer 14*a* made of silicone rubber in a form of sponge, or the like, formed on a surface of the core metal 14*b*. The elastic layer 14*a* is rendered in a sponge form to take air inside, thereby having thermal insulation property to suppress an increase in temperature of the fusing belt 13, as well as enlarging the nipping area n. The elastic layer 14*a* furthermore pushes uniformly toner layers having different colors and thicknesses respectively, composing the multicolored toner image 20 when fusing the multicolored toner image 20.

The pressure roller 15 is provided with a core metal 15*b* composed of a tube of a metal, e.g., aluminum, iron, or the like, and an elastic layer 15*a* made of silicone rubber or the like, formed on a surface of the core metal 15*b*, and has inside a heater 16 such as, e.g., the halogen lamp. The elastic layer 15*a* pushes uniformly the fused toner layers having different thicknesses respectively at a time of double side printing.

Numeral 17 is a separation piece disposed as in contact with the fusing belt 13, and the separation piece 17 separates the sheet 22 from the fusing belt 13 in a case where the sheet 22 to be delivered from the nipping area n in a direction of arrow E wrapps around the fusing belt 13.

Operation of the fusing device thus structured is explained next.

The heaters 12, 16 are first rendered to generate heats to heat the heating roller 11 and the pressure roller 15. Next, the fusing roller 14 is rotated in the direction of the arrow G by driving a motor, not shown, so that the fusing belt 13 is driven to move in the direction of the arrow J in accordance with the fusing roller 14; the heating roller 11 is driven to rotate in the direction of the arrow H in accordance with the fusing belt 13; and the pressure roller 15 is driven to rotate in the direction of the arrow K in accordance with the fusing belt 13.

When the temperature of the fusing belt 13 heated with the heating roller 11 and the pressure roller 15 reaches the set fusing temperature, the sheet 22 is conveyed in the direction of the arrow S to fuse the toner image 20 onto the sheet 22 at the nipping area n, and subsequently the sheet 22 is delivered in the direction of the arrow E. It is to be noted that where the sheet 22 wraps around the fusing belt 13, the separation piece 17 separates the sheet 22 from the fusing belt 13.

In the meantime, a pressingly deformed amount of the elastic layer 14*a* of the fusing roller 14 needs to be increased to widen the nipping width at the nipping area n.

Therefore, the thickness of the elastic layer 14*a* is made thicker while urging force for rendering the pressure roller 15 in pressurized contact with the fusing roller 12 is made greater with the spring 19.

With the conventional fusing device, however, in a case of a small diameter of the fusing roller 14, the fusing roller 14 bends, thereby causing a difference in the nipping width between a central portion and opposite ends in a longitudinal direction of the fusing roller 14, so that defective fusing comes to easily occur.

It is conceivable to reduce hardness of the elastic layer 14*a* to widen the nipping width by that much, however, in that case it become impossible to pressure sufficiently the toner image 20 in which the toner layers are overlaid, so that the defective fusing easily occurs as well.

It is an object of this invention to solve the problems on the conventional fusing device as described above, and to provide a fusing roller capable of preventing occurrence of defective fusing.

SUMMARY OF THE INVENTION

To achieve the above objects, a fusing device according to this invention has a roller; a fusing belt heated and driven along a circumference of the roller; a pressure member disposed outside the fusing belt in pressurized contact with the roller through the fusing belt; and a pushing member disposed inside said fusing belt as arranged together with said roller on an upstream side with respect to said roller in a driving direction of said fusing belt and made in pressurized contact with said pressure member via said fusing belt.

The fusing belt and the pressure member form a contact area for allowing a recording medium to pass through.

The fusing device according to this invention has the roller; the fusing belt heated and rendered to drive along the circumference of the roller; the pressure member disposed outside the fusing belt and rendered in pressurized contact with the roller through the fusing belt; and the pushing member disposed inside said fusing belt as arranged together with said roller on an upstream side with respect to said roller in a driving direction of said fusing belt and made in pressurized contact with said pressure member via said fusing belt.

Furthermore, the fusing belt and the pressure member form the contact area for allowing the recording medium to pass through.

In the above case, the pushing member is disposed inside the fusing belt, as arranged together with and on the upstream side with respect to the roller in the driving direction of the fusing belt, and rendered in pressurized contact with the pressure member through the fusing belt, so that the contact area becomes larger. Therefore, since the diameter of the roller can be reduced, pressure required for fusing can be reduced.

As the result, the roller comes not to bend even in a case of having a small diameter, so that the nipping width becomes unified between the central portion and opposite ends in the longitudinal direction of the roller, and thus defective fusing can be prevented from occurring.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF PREFERRED EMBODIMENTS OF THE INVENTION

Figure 1:
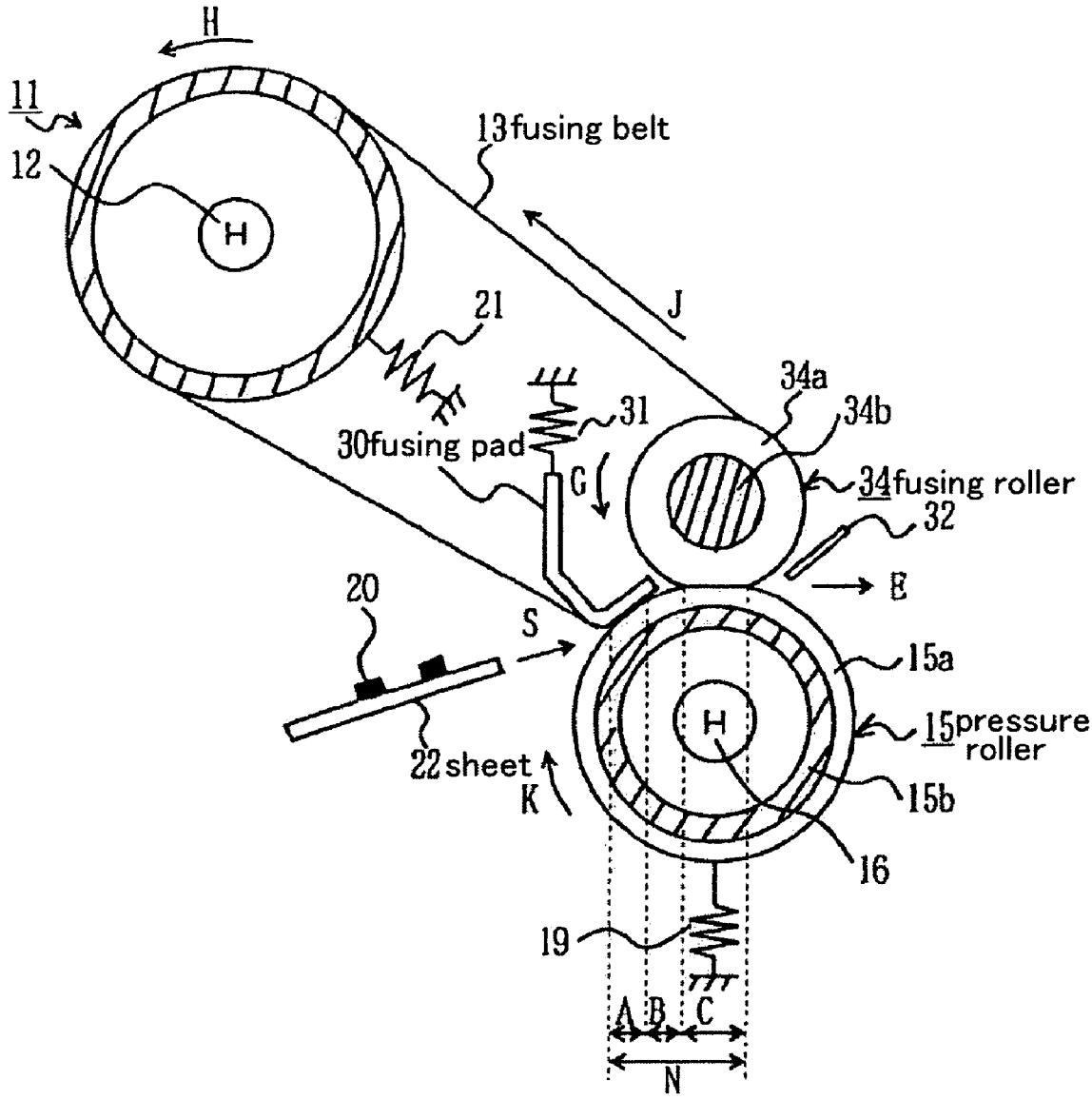
FIG. 1 is a cross-sectional view showing a fusing device of a belt type according to the first embodiment of this invention.
Figure 2:
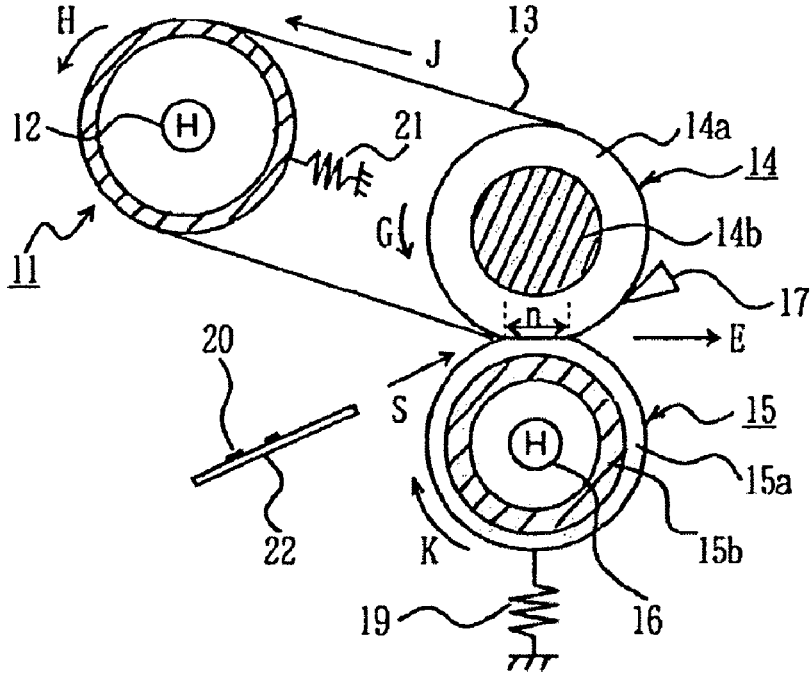
FIG. 2 is a cross-sectional view showing a conventional fusing device of a belt type.
Figure 4:
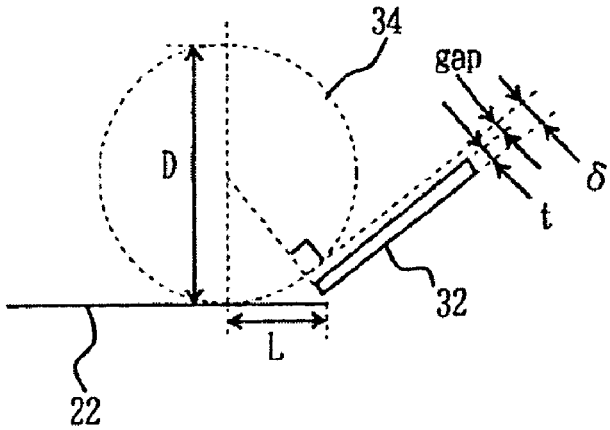
FIG. 4 is an illustration for operation of a separator according to the first embodiment of this invention.
Figure 5:
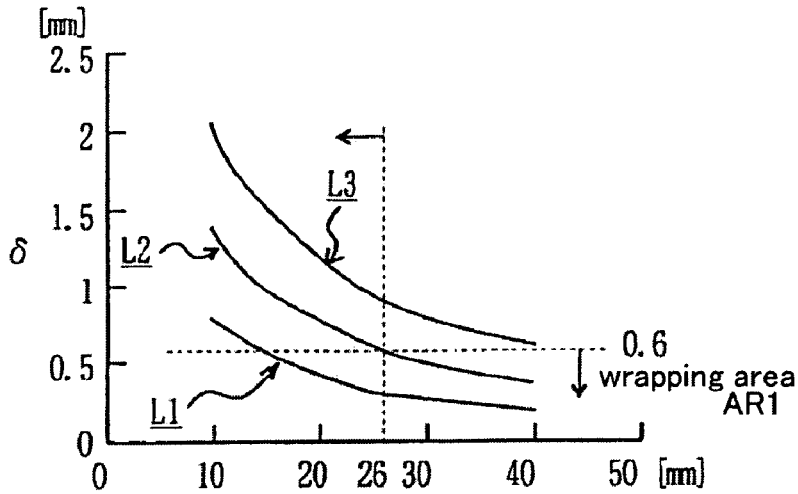
FIG. 5 is an illustration for a wrapping area according to the first embodiment of this invention.
Figure 6:
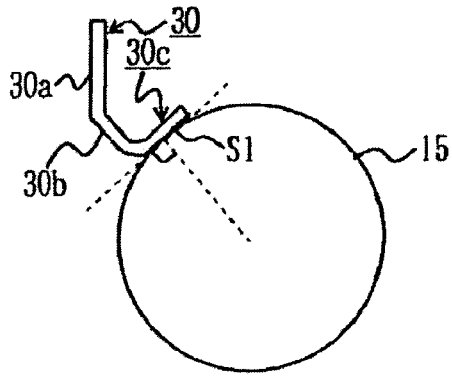
FIG. 6 is a view showing a state where a fusing pad is disposed according to the first embodiment of this invention.

Hereinafter, embodiments according to this invention will be described in detail with reference to the drawings. In this case, a fusing device of a belt type mounted to a printer of an electrophotographic type as an image forming apparatus will be described FIG. 1 is a cross-sectional view showing a fusing device of a belt type according to the first embodiment of this invention; FIG. 4 is an illustration for operation of a separator according to the first embodiment of this invention; FIG. 5 is an illustration for a wrapping area according to the first embodiment of this invention; and FIG. 6 is a view showing a state where a fusing pad is disposed according to the first embodiment of this invention. In FIG. 5, it is to be noted that an abscissa indicates diameter D of the fusing roller while an ordinate indicates a flouting margin a of the sheet 22 serving as a recording medium.

In that case, a surface of a photosensitive drum, not shown, serving as an image carrier is charged uniformly and equally with a charging roller, not shown, serving as a charging device, and subsequently exposed with an exposure device, not shown, so that an electrostatic latent image is formed. The electrostatic latent image is developed upon adhered with a toner serving as a developing agent by a developing device, not shown, to form toner images respectively having each color, defined as developer images. The toner images respectively having each color are subsequently transferred as overlaid to the sheet 22 serving as the recording medium with a transfer roller, not shown, serving as a transfer device, thereby forming a multicolored image 20. It is to be noted that in this embodiment, the sheet 22 is used as the recording medium but an OHP sheet or the like can be used instead of the sheet 22.

In the meantime, in FIG. 1, numeral 11 is a heating roller serving as a heating member, rendered to rotate in a direction of arrow H; numeral 13 is a fusing belt heated and driven in a direction of arrow J; numeral 34 is a fusing roller serving as a fusing member, disposed inside the fusing belt 13 and rendered to rotate in a direction of arrow G; numeral 15 is a pressure roller serving as a pressure member, disposed outside the fusing belt 13, made in pressurized contact with the fusing roller 34 through the fusing belt 13, and rendered to rotate in a direction of arrow K; and numeral 30 is a fusing pad serving as a pushing member disposed inside the fusing belt 13, as arranged together with, i.e., as arranged adjacent to and on an upstream side with respect to the fusing roller 34 in a driving direction of the fusing belt 13. The fusing roller 34 composes the first roller; the pressure roller 15 composes the second roller; and the heating roller 11 composes the third roller. The fusing belt 13 is driven along a circumference of the heating roller 11, the fusing roller 34, and the fusing pad 30.

The fusing belt 13 is arranged as tensioned among the heating roller 11, the fusing pad 30, and the fusing roller 34, and rendered to drive the direction of the arrow J. The pressure roller 15 is urged with a spring 19 serving as the first urging member, and rendered in pressurized contact with the fusing roller 34 through the fusing belt 13, while the fusing pad 30 is urged with a spring 31 serving as the second urging member, and rendered in pressurized contact with the pressure roller 15 through the fusing belt 13. The fusing belt 13 and the pressure roller 15 form, between the fusing roller 34 and the fusing pad 30, and the pressure roller 15, a nipping area N defined as a predetermined contact area for allowing the sheet 22 to pass over. The sheet 22 is conveyed in a direction of arrow S, transmitted to the nipping area N, and nipped between the fusing roller 34 and the pressure roller 15 through the fusing belt 13. The heating roller 11 is urged with a spring 21 serving as the third urging member, in a direction opposite to the fusing roller 34, thereby causing predetermined tension on the fusing belt 13. It is to be noted that pushing force of the spring 31, for rendering the fusing pad 30 in pressurized contact with the pressure roller 15 is set to be less than pushing force of the spring 19, for rendering the pressure roller 15 in pressurized contact with the fusing roller 34. To heat the fusing belt 13 effectively, the heating roller 11 has inside a heater 12 defined as the first heating source such as, e.g., a halogen lamp or the like and heats the fusing belt 13. The heating roller 11 is made of a metal having a high thermal conductivity, such as, e.g., aluminum, iron, etc.

The fusing belt 13 provides the toner image 20 at the nipping area N with the heat received through the heating roller 11, thereby fusing to the sheet 22 the toner image 20 formed on the sheet 22.

Figure 3:
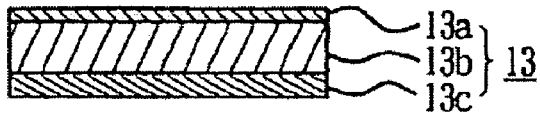
FIG. 3 is a cross-sectional view of a conventional fusing belt.

As described above, the fusing belt 13 is composed of an external layer 13*a* (see FIG. 3), an intermediate layer 13*b*, and an internal layer 13*c*, in which the external layer 13*a* is made of a resin having a high mold releasing property, such as, e.g., a PFA etc. and suppresses adherence of toner to the fusing belt 13. The intermediate layer 13*b* is made of a resin having a good elasticity, such as, e.g., silicone rubber, while the internal layer 13*c* is made of a material having rigidity and thermal resistance, such as a metal, e.g., nickel, stainless, etc. or such as a resin, e.g., polyimide etc., and made thin to obtain flexibility, for example, thickness is set to 30 to 50 microns in a case of a metal, while set to 50 to 100 microns in a case of a resin.

The fusing roller 34 is provided with a core metal 34*b* made of a metal such as, e.g., aluminum, iron, or the like, and an elastic layer 34*a* made of silicone rubber in a sponge form, or the like, formed on a surface of the core metal 34*b*. The elastic layer 34*a* is rendered in a sponge form to take in air inside, thereby having thermal insulation property to suppress an increase in temperature of the fusing belt 13, as well as enlarging the nipping area n. The elastic layer 34*a* furthermore pushes uniformly toner layers having different colors and thicknesses respectively, composing the multicolored toner image 20 when fusing the multicolored toner image 20.

The pressure roller 15 is provided with a core metal 15*b* composed of a tube of metal such as, e.g., aluminum, iron, or the like, and an elastic layer 15*a* made of silicone rubber or the like, formed on a surface of the core metal 15*b*, and has inside the heater 16 defined as the second heating source such as, e.g., the halogen lamp etc. At a time of double side printing, the elastic layer 15*a* pushes uniformly after absorbing the fused toner layers having different thicknesses respectively, or unevenness on the sheet 22 of each type, for example, unevenness on a rear surface of an envelope. It is to be noted that a surface of the elastic layer 15*a* is coated with a fluoric resin, thereby enhancing releasing property of the sheet 22 at a time that a fusing surface of the fused toner image 20 comes in contact with the pressure roller 15 in a double side printing.

Numeral 32 is a separator serving as a separating device, disposed as in contact with the fusing belt 13, in which the separator 32 separates the sheet 22 from the fusing belt 13 when the sheet 22 to be delivered from the nipping area N in a direction of arrow E wraps around the fusing belt 13.

Therefore, as shown in FIG. 4, the separator 32 is disposed with a prescribed spatial distance G between the separator 32 and the fusing roller 34. In FIG. 4, alphabet D indicates a diameter of the fusing roller 34; alphabet L indicates a distance of a margin where no image is formed on the sheet 22; alphabet t indicates a thickness of the separator 32; and Greek alphabet ä indicates the floating margin of the sheet 22. In this embodiment, the thickness t of the separator 32 is set to 0.4 [mm]; the distance L of the margin of the sheet 22 is set to 4 [mm]; and the spatial distance G is set to 0.2 [mm].

FIG. 5 illustrates a relation among the diameter D, the floating margin ä, and the distance L. In this case, since the distance L of the margin is set to 4 [mm], a property thereof is expressed by line L2 among lines L1 to L3. It is found out by experiments that when the diameter D of the fusing roller 34 is larger than 26 [mm], the floating margin ä becomes smaller than 0.6 [mm], thereby falling within wrapping area AR1 as shown in FIG. 5, so that wrapping happens to the sheet 22. Therefore, in this embodiment, the diameter D of the fusing roller 34 is set to less than 26 [mm].

In the meantime, the fusing pad 30 is disposed to enlarge the nipping area N, and as shown in FIG. 6, composed of a base portion 30*a* equipped with the spring 31; a supporting portion 30*b* extending from a lower end of the base portion 30*a* toward the pressure roller 15; and a pressurized contact portion 30*c* extending from a lower end of the supporting portion 30*b* toward a tangential line of the pressure roller 15, rendered in pressurized contact with the pressure roller 15 through the fusing belt 13, in which a pressurized contact surface S1 is formed on the pressurized contact portion 30*c*. The fusing pad 30 is formed of material easily processed and has a great rigidity, such as metal, e.g., iron etc.

The nipping area N, in the meantime, is a portion at which the fusing belt 13 and the pressure roller 15 come in contact with each other, and composed of area A at which the fusing pad 30 is rendered in pressurized contact with the pressure roller 15 through the fusing belt 13; area B at which the fusing belt 13 is rendered in contact with the pressure roller 15; and area C at which the pressure roller 15 is rendered in pressurized contact with the fusing roller 34 through the fusing belt 13.

In that case, the pressurized contact portion 30*c* stretches in a direction of the tangential line of the pressure roller 15, so that the fusing pad 30 is stably rendered in pressurized contact with the pressure roller 15 on the area A.

Operation of the fusing device thus structured is explained next.

Figure 7:
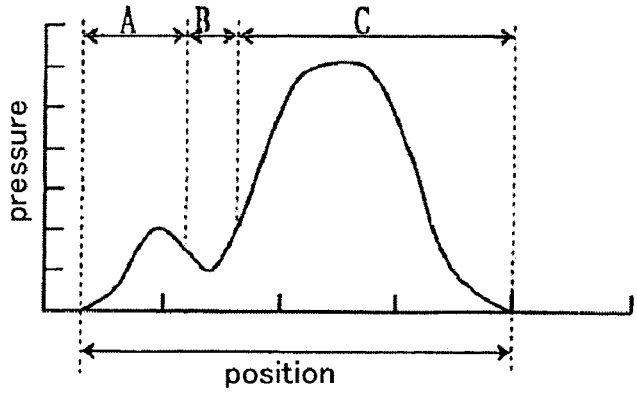
FIG. 7 is a chart showing pressure distribution inside a nipping area according to the first embodiment of this invention.

FIG. 7 is a chart showing pressure distribution inside a nipping area according to the first embodiment of this invention. In FIG. 7, it is to be noted that an abscissa indicates a position on the nipping area N while an ordinate indicates the pressure.

First, the heaters 12 (in FIG. 1), 16 generate heat to heat up the heating roller 11 and the pressure roller 15. The fusing roller 34 is next rendered to rotate in the direction of the arrow G by a driving motor, not show, so that the fusing belt 13 is rendered to drive in the direction of the arrow J in accordance with the fusing roller 34; the heating roller 11 is driven to rotate in the direction of the arrow H in accordance with the fusing belt 13; and the pressure roller 15 is driven to rotate in the direction of the arrow K in accordance with the fusing belt 13.

When the temperature of the fusing belt 13 heated with the heating roller 11 and the pressure roller 15 reaches the set fusing temperature, the sheet 22 is conveyed in the direction of the arrow S, and the multicolored toner image 20 is fused onto the sheet 22 at the nipping area N, so that the multicolored image is formed. In this situation, in the pressure distribution inside the nipping area N as shown in FIG. 7, the pressure due to the urging force of the spring 31 is exerted to the area A; the pressure becomes low at the area B; and the pressure due to the urging force of the spring 19 is exerted to the area C.

Subsequently, when the sheet 22 passes through the area C, the fusing is completed, and the sheet 22 is delivered in the direction of the arrow E, but in this situation, it may happen that the sheet 22 wraps around the fusing belt 13 where adhesive force between the fusing belt 13 and the toner image 20 is strong. However, in this case, since the toner image 20 is not formed on the margin at a front end side of the sheet 22, the sheet 22 is delivered in the direction of the tangent line of curvature of the fusing belt 13 without wrapping around the fusing belt 13, and the margin touches the opposite side of the fusing belt 13 at the separator 32, so that the sheet 22 is separated from the fusing belt 13.

Thus, with the fusing device of the belt type, the heating roller 11 is separated from the nipping area N with the fusing belt 13, and the fusing roller 34 is made of material having the thermal conductivity, such as, e.g., silicone rubber in the sponge form, or the like, so that not only can the nipping area N be enlarged, but also the fusing pad 30 renders the nipping area N enlarged more, so that the area C between the pressure roller 15 and the fusing roller 34 can be made smaller by that much.

Since the diameter D of the fusing roller 34 therefore can be rendered smaller, both the pressure required for fusing and the urging force with the spring 19 can be smaller. As the result, the fusing roller 33 does not bend even in a case of the small diameter D of the fusing roller 34, so that any difference in the nipping width between a central portion and opposite ends in a longitudinal direction of the fusing roller 14 does not occur, and defective fusing therefore can be prevented from occurring.

Furthermore, since hardness of the elastic layer 34*a* need not be made low to widen the nipping width, the sheet 22 on which the plural toner layers are overlaid can be pressurized sufficiently, so that defective fusing can be furthermore prevented from occurring.

Because the diameter D of the fusing roller 34 can be reduced, not only can the duration of increasing temperature of the fusing belt 13 be shortened, but also heat capacity of the fusing roller 34 becomes smaller, thereby enabling the thermal amount transferred from the fusing belt 13 to the fusing roller 34 to be reduced.

Furthermore, since the mold releasing property of the sheet 22 can be enhanced by an amount corresponding to the shortening of the diameter D of the fusing roller, a use of the separation piece is not needed, so that the separator 32 can be disposed at a distant position from the fusing roller 34. The fusing roller 13 therefore does not get damaged.

In the meantime, in the first embodiment, though a metal is to be used as a material of the fusing pad 30, when the nipping area A is enlarged to widen the nipping width further, the heat capacity of the fusing pad 30 becomes greater, so that the duration of increasing temperature of the fusing belt 13 undesirably becomes longer.

Herein, the second embodiment of this invention will be explained, in which a thermal insulating member is disposed at a portion of the fusing pad 30, in contact with the fusing belt 13. It is to be noted that members structured the same as in the first embodiment are assigned with the same numerals to omit the duplicated explanation, and the advantages of this invention are applicable to the second embodiment because of the same structure as the first embodiment.

Figure 8:
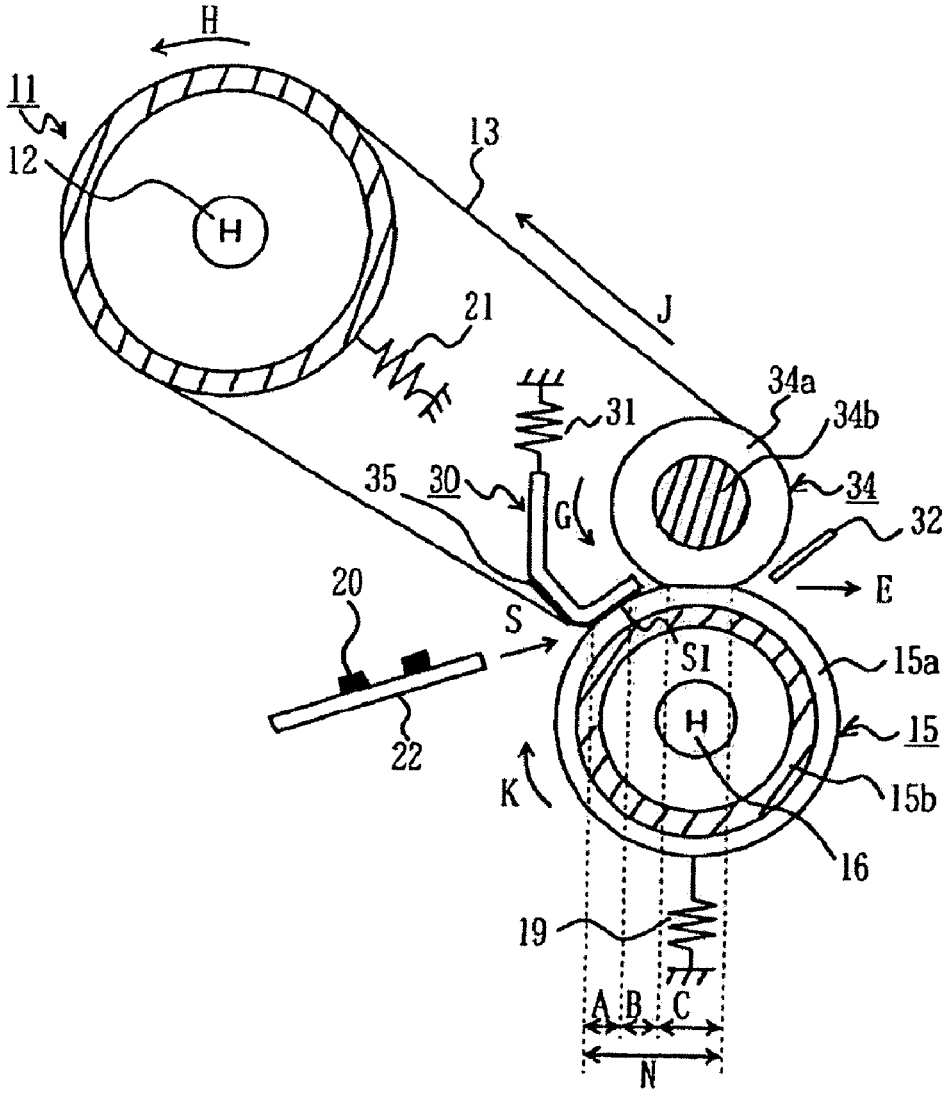
FIG. 8 is a cross-sectional view showing a fusing device of a belt type according to the second embodiment of this invention.
Figure 9:
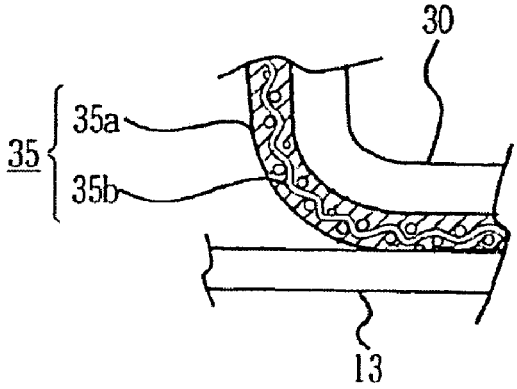
FIG. 9 is a cross-sectional view showing a thermal insulating member according to the second embodiment of this invention.

FIG. 8 is a cross-sectional view showing a fusing device of a belt type according to the second embodiment of this invention, and FIG. 9 is a cross-sectional view showing a thermal insulating member according to the second embodiment of this invention.

In this case, on a contact surface of the fusing pad 30 serving as the pushing member, in contact with the fusing belt 13, a thermal insulating member 35 having a resin made surface is disposed over the supporting portion 30*b* (in FIG. 6) and the pressurized contact area 30*c*. The thermal insulating member 35 is composed of a member in which the fluoric resin 35*a* having a small friction coefficient is coated on a surface of a cloth 35*b* in which glass, aramid fiber, or the like having a high thermal resistance and rigidity is plaited in a cloth way. In this case, because having the cloth 35*b*, the thermal insulating member 35 has the great strength and thermal resistance, etc., and the thermal insulating member 35 has higher sliding property since a surface thereof is coated with the fluoric resin 35*a*. The cloth 35*b* serving as a base material is plaited in the cloth way, and a surface thereof is coated as rubbed with the resin 35*a*, so that undulations on the surface thereof are formed, and thus an air layer is formed between the pressurized contact area S1 and the fusing belt 13. Therefore, the thermal insulating member 35 can enjoy enhanced thermal insulation property. It is to be noted that the pressurized contact portion 30*c* and the thermal insulating member 35 compose a pressurized contact portion of the fusing pad 30, in which the pressurized contact area S1 is formed on the pressurized contact area.

Furthermore, because the sliding property between the thermal insulating member 35 and the fusing belt 13 is needed, the thermal insulating member 35 is formed by coating the surface of the fusing pad 30 with the fluoric resin so the thickness of the fluoric resin as to be of 10 to 100 microns. It is to be noted that as the thermal insulating member 35, a plate member made of the fluoric resin may be used and adhered to the fusing pad 30, or the surface of the fusing pad 30 may be formed as united with a thermal insulating member.

In this embodiment, the pressure distribution inside the nipping area N is as shown in FIG. 7, likewise the first embodiment.

As described above, in this embodiment, the thermal insulating member 35 is disposed over the supporting portion 30*b* and the pressurized contact portion 30*c* on the contact area of the fusing pad 30, in contact with the fusing belt 13, so that the heat is hardly transmitted from the fusing belt 13 to the fusing pad 30, and the duration of increasing temperature of the fusing belt 13 can be therefore shortened.

In the meantime, in the above first and second embodiments, the area B of low pressure is undesirably formed between the area A and the area C. This is because the surface of the pressure roller 15, serving as the pressure member as well as the second roller, is in pressurized contact not with the fusing pad 30 but with the fusing roller 34 serving as the first roller, and as this result, the pressure roller 15 is deformed to render the pressure which the fusing pad 30 applies on the pressure roller 15 lower as coming closer to the area B.

Thus, there are the area A and area B of high pressure as well as the area C of low pressure, and when the sheet 22 defined as the recording medium moves, in accordance with rotation of the pressure roller 15, from the area A of high pressure to the area B of low pressure on the surface of the pressure roller 15, binding force on the toner becomes weak, and the toner image tends to easily shift in a conveyance direction of the sheet 22.

Herein, the third embodiment of this invention will be explained, in which the toner image can be prevented from shifting positionally. It is to be noted that members structured the same as in the first embodiment and the second embodiment are assigned with the same numerals to omit the duplicated explanation, and the advantages of this invention are applicable to the third embodiment because of the same structure as the first embodiment and the first embodiment.

Figure 10:
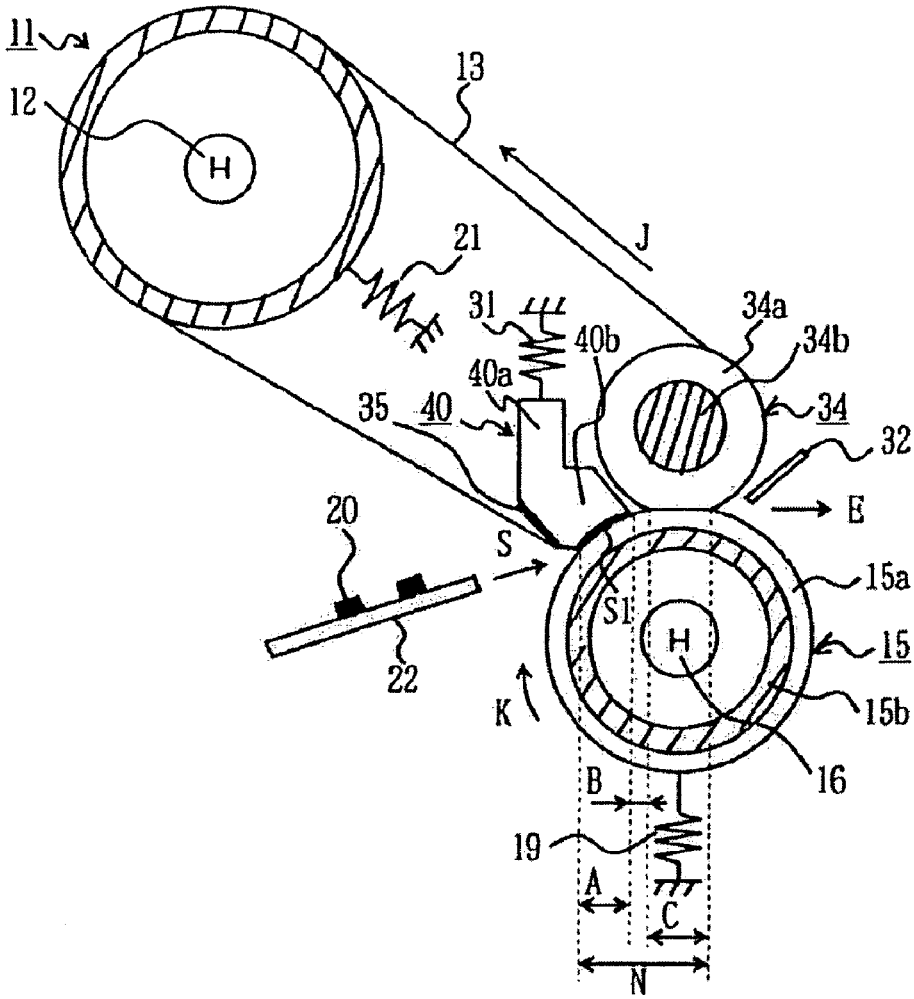
FIG. 10 is a cross-sectional view showing a fusing device of a belt type according to the third embodiment of this invention.
Figure 11:
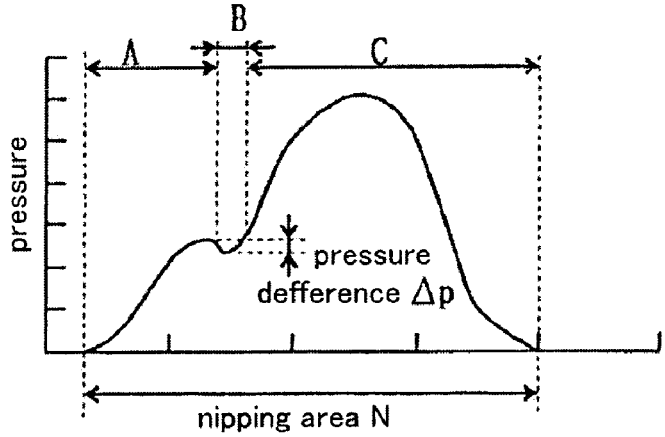
FIG. 11 is a chart showing pressure distribution inside a nipping area according to the third embodiment of this invention.

FIG. 10 is cross-sectional view showing a fusing device of a belt type according to the third embodiment of this invention, and FIG. 11 is a chart showing pressure distribution inside a nipping area according to the third embodiment of this invention. Accordingly, in FIG. 11, an abscissa indicates a nipping area N while an ordinate indicates the pressure.

In that case, as shown in FIG. 10, a fusing pad 40 serving as the pushing member has a base portion 40*a* equipped with the spring 31 serving as the second urging member and a pressurized contact portion 40*b* formed as extending from a lower end of the base portion 40*a* toward the pressure roller 15 serving as the pressure member as well as the second roller, and a contact portion of the pressurized contact portion 40*b* in contact with the fusing belt 13 is formed so as to have the same curvature as that of a circumferential surface of the pressure roller 15. The pressurized contact portion 40*b* and the thermal insulating member 35 compose a pressurized contact portion of the fusing pad 40, and the pressurized contact surface S1 is formed on the pressurized contact portion. Therefore, the surface of the pressure roller 15 is not rendered in pressurized contact with the fusing pad 40 at the area B, and deformation of the fusing roller 15 can be suppressed, so that it can be prevented that the pressure which the fusing pad 40 applies on the pressure roller 15 becomes lower as approaching closer to the area B. As the result, as shown FIG. 11, not only can the area B be made smaller compared with the fist embodiment, but also a difference in a peak value of the pressure, i.e., pressure difference $\Delta p$, between the area A and the area B can be reduced. Accordingly, the toner image can be prevented from positionally shifting in the conveyance direction of the sheet 22.

In the third embodiment, in the meantime, since an interval is left between the fusing pad 40 and the fusing roller 34 to prevent the fusing pad 40 and the fusing roller 34 as the first roller from interfering with each other, the area B is undesirably formed. Therefore, the fourth embodiment will be explained, in which the area B is not formed. It is to be noted that members structured the same as in the first embodiment, the second embodiment, and the third embodiment are assigned with the same numerals to omit the duplicated explanation, and the advantages of this invention are applicable to the fourth embodiment because of the same structure as the first embodiment, the second embodiment, and the third embodiment.

Figure 12:
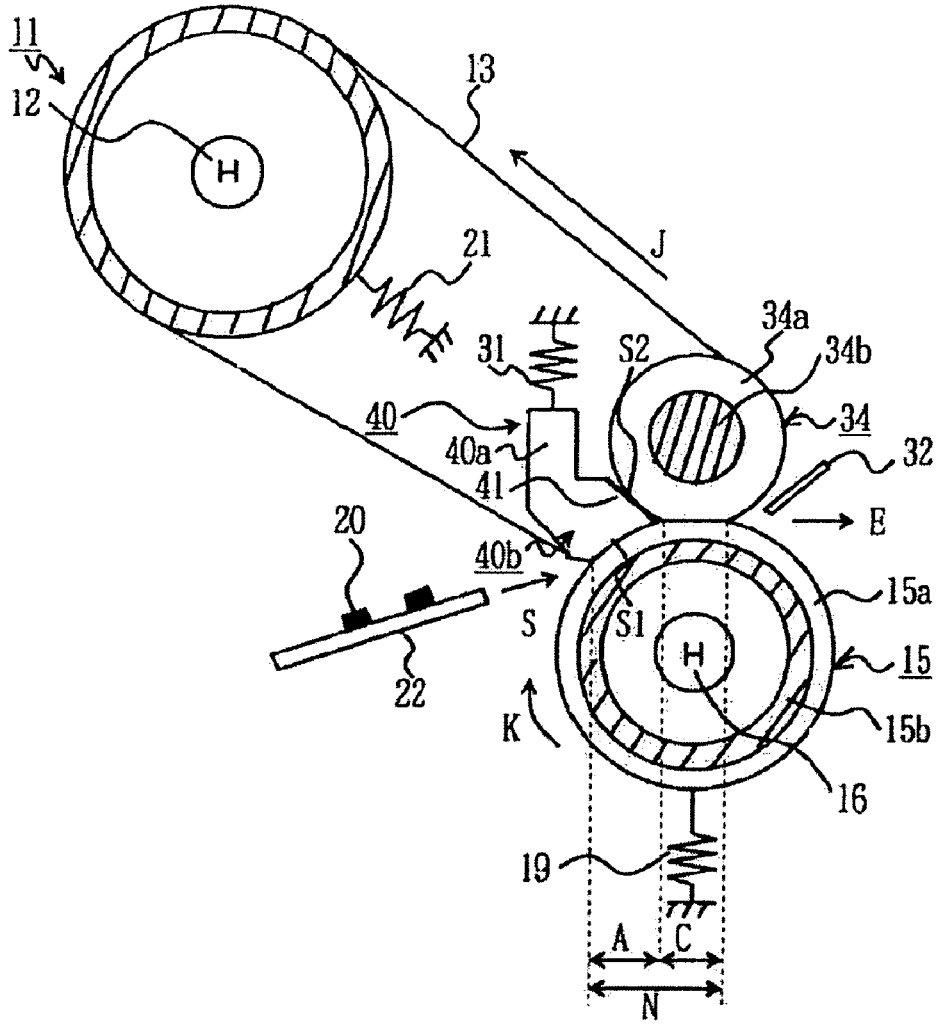
FIG. 12 is a cross-sectional view showing a fusing device of a belt type according to the fourth embodiment of this invention.
Figure 13:
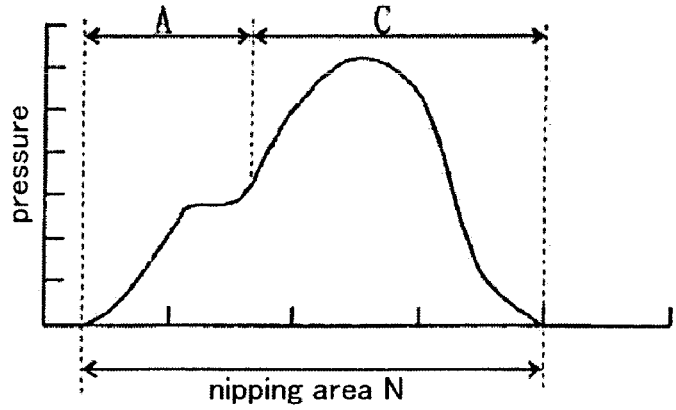
FIG. 13 is a chart showing pressure distribution inside a nipping area according to the fourth embodiment of this invention.

FIG. 12 is a cross-sectional view showing a fusing device of a belt type according to the fourth embodiment of this invention, and FIG. 13 is a chart showing pressure distribution inside a nipping area according to the fourth embodiment of this invention. In FIG. 13, it is to be noted that an abscissa indicates a nipping area N while an ordinate indicates the pressure.

As shown in FIG. 12, the fusing pad 40 serving as the pushing member has the base portion 40*a* equipped with the spring 31 serving as the second urging member and the pressurized contact portion 40*b* formed as extending from the lower end of the base portion 40*a* toward the pressure roller 15 serving as the pressure member as well as the second roller and further toward the fusing roller 34 serving as the first roller, and the pressurized contact surface S1 defined as the first facing surface is formed on the pressurized contact portion 40*b*, as facing the pressure roller 15 so the curvature of the pressurized contact surface S1 as to be the same as that of the circumferential surface of the pressure roller 15, while a sliding surface S2 defined as the second facing surface is formed as facing the fusing roller 34. Therefore, the fusing pad 40 is rendered in pressurized contact with the pressure roller 15 through the fusing belt 13 on the pressurized contact portion 40*b*, while sliding as in contact with the fusing roller 34, along the circumferential surface of the fusing roller 34.

An intersection line of the pressurized contact surface S1 and the sliding surface S2, i.e., a front end portion of the fusing pad 40, is formed as fronting vicinity, i.e., an end portion, of the area C, and the area A is formed on the pressurized contact surface S1 while the area C is formed on the pressurized contact surface S2. Therefore, since the area B is never formed, the fusing pad 40, as shown in FIG. 13, comes in pressurized contact with the surface of the pressure roller 15 on an entire area of the nipping area N, so that the deformation of the pressure roller 15 can be prevented, and so that the pressure which the fusing pad 40 applies on the pressure roller 15 can be prevented from getting lower. As a result, the pressure difference Δp at the area A can be eliminated, and thus the toner image can be prevented surely from positionally shifting in the conveyance direction of the sheet 22.

By coating a portion of the fusing pad 40 in face of the fusing roller 34 with a fluoric resin 41, a contact surface of the resin 41 in contact with the fusing roller 34 can be made to a sliding surface. In this case, the sliding property is improved, and a rotating load applied on the fusing roller 34 can be therefore reduced.

In the meantime, in the fourth embodiment, torque of the motor, i.e., motor torque required for rotating the fusing roller 34 undesirably increases. Thus, if the torque of the motor is made smaller, the front end portion of the fusing pad 40 needs to be sharpened, thereby resulting in the thin thickness. Furthermore, because the fusing pad 40 is formed of, e.g., a metal, when the thickness of the front end portion is thinned, the front end portion easily gets deformed in a plastic manner, so that durability of the fusing device may be deteriorated. Where the front end portion of the fusing pad 40 is plastically deformed, the pressure distribution inside the nipping area N changes, thereby causing defective fusing to easily occurs.

Herein, the fifth embodiment will be explained, in which the torque of the motor for rotating the fusing roller 34 can be reduced, the durability of the fusing device can be enhanced, and the occurrence of the defective fusing can be prevented. It is to be noted that members structured the same as in the first embodiment are assigned with the same numerals to omit the duplicated explanation, and the advantages of this invention are applicable to the fifth embodiment because of the same structure as the first embodiment.

Figure 14:
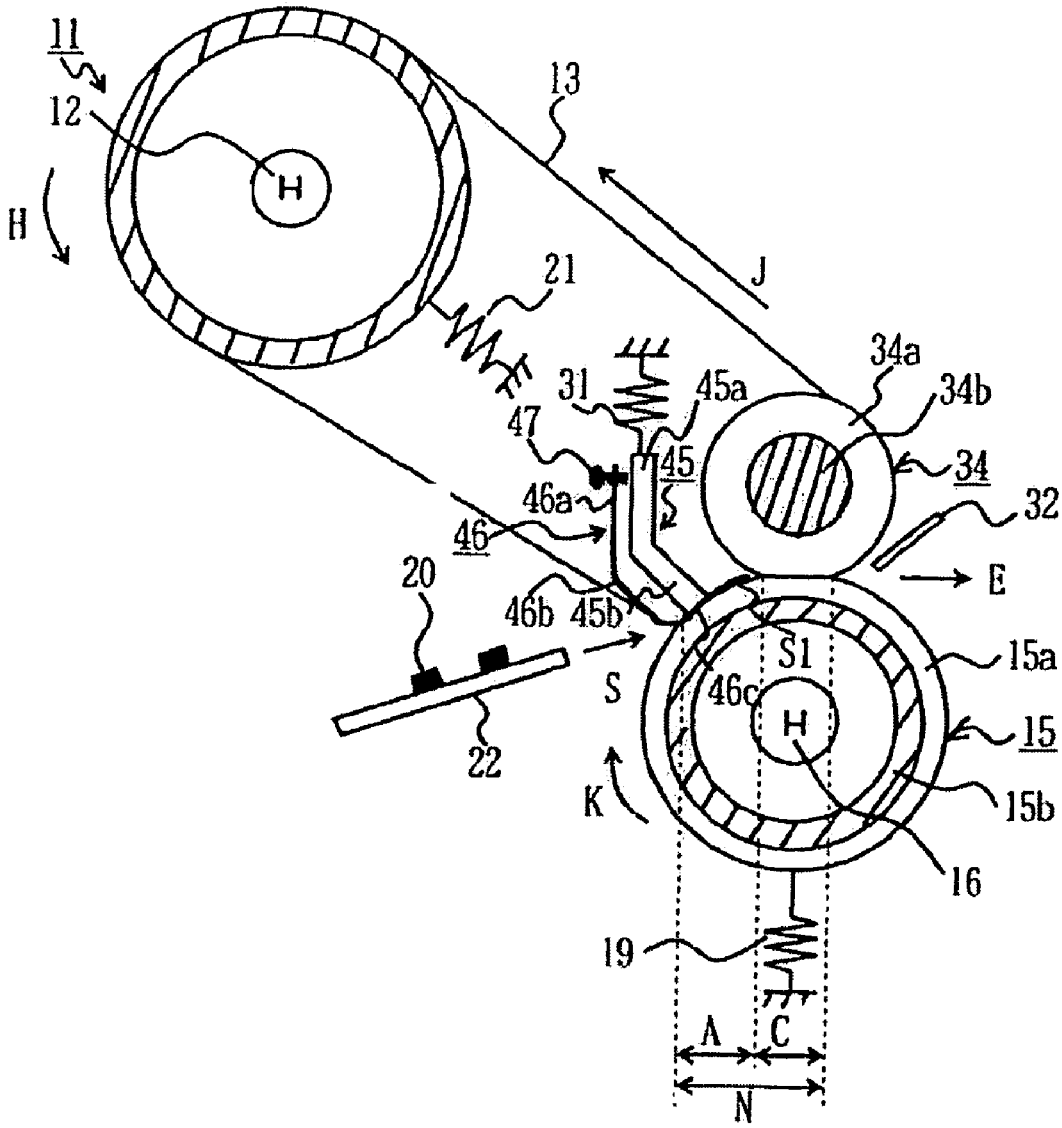
FIG. 14 is a cross-sectional view showing a fusing device of a belt type according to the fifth embodiment of this invention.

FIG. 14 is a cross-sectional view showing a fusing device of a belt type according to the fifth embodiment of this invention.

As shown in FIG. 14, a fusing pad 45 defined as the pushing member has the base portion 45*a* equipped with the spring 31 serving as the second urging member and a pressurized contact portion 45*b* extending from a lower end of the base portion 45*a* toward the pressure roller 15 serving as the pressure member as well as the second roller, and a portion of the pressurized contact portion 45*b*, at which the fusing pad is rendered in pressurized contact with the pressure roller 15 through the fusing belt 13, is disposed with a distance from the area C.

To prevent a front end of the fusing pad 45 from plastically deformed, the fusing pad 45 is equipped with a leaf spring 46 serving as the pressurized contact member and serving as a plate shaped member. The leaf spring 46 is formed of a metal such as, e.g., stainless steel, or the like, and has a base portion 46*a* equipped with the sprint 31, a supporting portion 46*b* formed from a lower end of the base portion 46*a* toward the pressure roller 15, and a pressurized contact portion 46*c* extending along the circumferential surface of the pressure roller 15 from a lower end of the supporting portion 46*b* toward a downstream side in a rotation direction of the pressure roller 15, and the fusing pad 45 is rendered in contact with the pressure roller 15 through the pressurized contact portion 46*c* and further through the fusing belt 13. The pressurized contact area S1 is formed on the pressurized contact portion 46*c*. The leaf spring 46 is mounted to the fusing pad 45 equipped with a screw 47 at vicinity of an upper end of the base portion 46*a*.

In that case, since the leaf spring 46 hardly deformed in a plastic manner is used as the fusing pad 45, the pressure distribution inside the nipping area N does not change, and the durability of the fusing device can be enhanced. Furthermore, the torque of the motor required for rotating the fusing roller 34 can be reduced. Defective fusing can be thus prevented from occurring, and the fusing can be stably implemented.

The air layer is formed between the fusing bad 45 and the leaf spring 46, thereby being able to enhance the thermal insulation property, and the duration of increasing temperature of the fusing belt 13 can be shortened.

In the meanwhile, in the pressure distribution inside the nipping area N according to the fourth embodiment and the fifth embodiment, as shown in FIG. 13, a portion at which the pressure intensively changes is formed between the area A and the area C, so that there is a possibility that the pressure difference Δp such as shown in FIG. 13 may occur when the spring 46's changes as the time goes render the rigidity of the front end portion of the leaf spring 46 low.

Therefore, the sixth embodiment of this invention will be explained, in which the pressure difference Δp due to the leaf spring 46's change over time does not occur. It is to be noted that members structured the same as in the fifth embodiment are assigned with the same numerals to omit the duplicated explanation, and the advantages of this invention are applicable to the sixth embodiment because of the same structure as the fifth embodiment.

Figure 15:
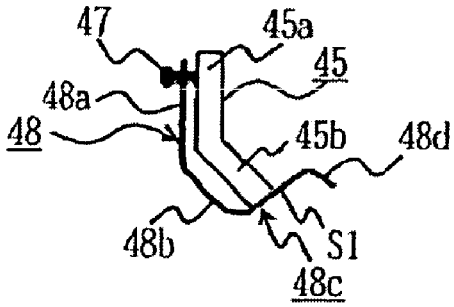
FIG. 15 is a cross-sectional view showing a leaf spring and a fusing pad according to the sixth embodiment of this invention.
Figure 16:
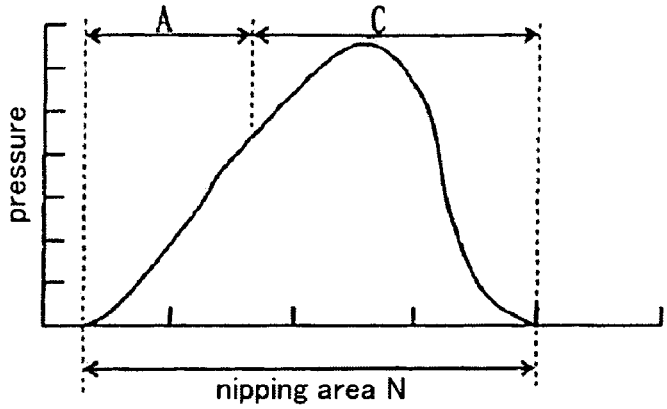
FIG. 16 is a chart showing pressure distribution inside a nipping area according to the sixth embodiment of this invention.

FIG. 15 is a cross-sectional view showing a leaf spring and a fusing pad according to the sixth embodiment of this invention, and FIG. 16 is a chart showing pressure distribution inside a nipping area according to the sixth embodiment of this invention. In FIG. 16, it is to be noted that an abscissa indicates a nipping area N while an ordinate indicates the pressure.

As shown in FIG. 15, a leaf spring 48 serving as the pressurized contact member as well as the plate shaped member includes: a base portion 48*a*; a supporting portion 48*b* formed from a lower end of the base portion 48*a* toward the pressure roller 15 (in FIG. 14) serving as the pressure member as well as the second roller; a pressurized contact portion 48*c* extending along with a circumferential surface of the pressure roller 15 from a lower end of the supporting portion 48*b* toward a downstream side in a rotation direction of the pressure roller 15; and a projecting portion 48*d* formed as projecting from a front end of the pressurized contact portion 48*c* toward the pressure roller 15, as extending in a radially inner direction. The fusing pad 45 serving as the pushing member is rendered in pressurized contact with the pressure roller 15 through the pressurized contact portion 48*c* and further through the fusing belt 13.

In that case, the projecting portion 48*d* stretches, at the front end portion of the leaf spring 48, in a radially inner direction of the pressure roller 15, so that in the pressure distribution inside the nipping area N, the pressure does not change intensively, as shown in FIG. 16, between the area A and the area C. Accordingly, since the pressure difference Δp due to the leaf spring 46's change over time, such as shown in FIG. 11, does not occur, the toner image does not shift in the conveyance direction of the sheet 22

It is to be noted that in this embodiment, the projecting portion 48*d* is formed at the front end portion of the leaf spring 48, however, instead of the projecting portion 48*d*, the fusing pads 30, 40 such as described in the second embodiment and the third embodiment, may be formed so a portion in vicinity of the area C as to be a projecting portion upon projecting it in the radially inner direction of the pressure roller 15.

In the fifth embodiment and the sixth embodiment, in the meantime, because the fusing pad 45 is in contact with the leaf springs 46, 48 at the front end of the fusing pad 45, the heat of the fusing belt 13 is transmitted to the fusing pad 45 through the leaf springs 46, 48, so that the duration of increasing the temperature of the fusing belt 13 undesirably becomes longer.

Herein, the seventh embodiment of this invention will be explained, in which the transmittance of the heat of the fusing belt 13 to the fusing pad 45 through the leaf springs 46, 48 can be suppressed. It is to be noted that members structured the same as in the first embodiment to the sixth embodiment are assigned with the same numerals to omit the duplicated explanation, and the advantages of this invention are applicable to the seventh embodiment because of the same structure as the first embodiment to the sixth embodiment.

Figure 17:
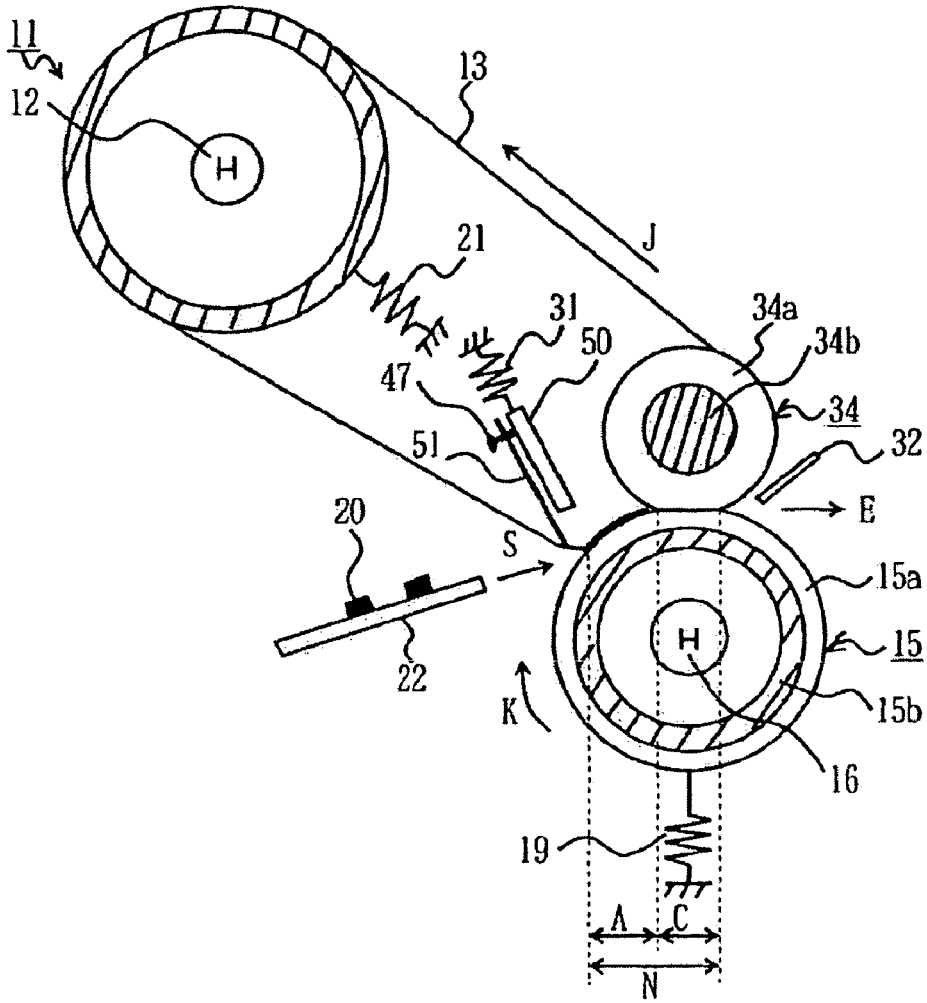
FIG. 17 is a cross-sectional view showing a fusing device of a belt type according to the seventh embodiment of this invention.
Figure 18:
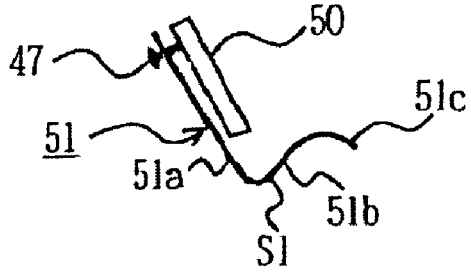
FIG. 18 is a cross-sectional view showing a leaf spring and a fusing pad according to the seventh embodiment of this invention.

FIG. 17 is a cross-sectional view showing a fusing device of a belt type according to the seventh embodiment of this invention, and FIG. 18 is a cross-sectional view showing a leaf spring and a fusing pad according to the seventh embodiment of this invention.

As shown in the drawings, a leaf spring 51 serving as the pressurized contact member as well as the plate shaped member has a base portion 51*a* equipped with the spring 31 serving as the second urging member, extending toward the pressure roller 15 serving as the pressure member; a pressurized contact portion 51*b* extending along the circumferential surface of the pressure roller 15 from a lower end of the base portion 51*a* toward a downstream side in the rotation direction of the pressure roller 15; and a projecting portion 51*c* extending from a front end of the pressurized contact portion 51*b* in the radially inner direction of the pressure roller 15, in which a fusing pad 50 and the leaf spring 51 compose the pushing member, and rendered in pressurized contact with the pressure roller 15 through the fusing belt 13.

In that case, a front end of the fusing pad 50 is formed as separated from the pressurized contact portion 51*b* of the leaf spring 51, so that the heat of the fusing belt 13 is transmitted slightly to the fusing pad 50 through the screw 47 after transmitted to the leaf spring 51. That is, the transmittance of the heat of the fusing belt 13 to the fusing pad 50 can be suppressed. The duration of increasing temperature of the fusing belt 13 therefore can be shortened.

In the seventh embodiment, in the meantime, the leaf spring 51 is formed of stainless steel, and the pressurized contact surface S1 of the leaf spring 51 in contact with the fusing belt 13 has poor flexibility, thereby hardly getting deformed, so that it becomes hard not only to apply the equal pressure in a length direction of the sheet 22 as the recording medium but also hard to operate a control of, e.g., a bend in a length direction or a size of the leaf spring 51.

Therefore, the eighth embodiment of this invention will be explained, in which the equal pressure can be easily applied in a length direction of the sheet 22, and a control of, e.g., the bend in a length direction or the size of the leaf spring 51 can be easily operated. It is to be noted that members structured the same as in the seventh embodiment are assigned with the same numerals to omit the duplicated explanation, and the advantages of this invention are applicable to the eighth embodiment because of the same structure as the seventh embodiment.

Figure 19:
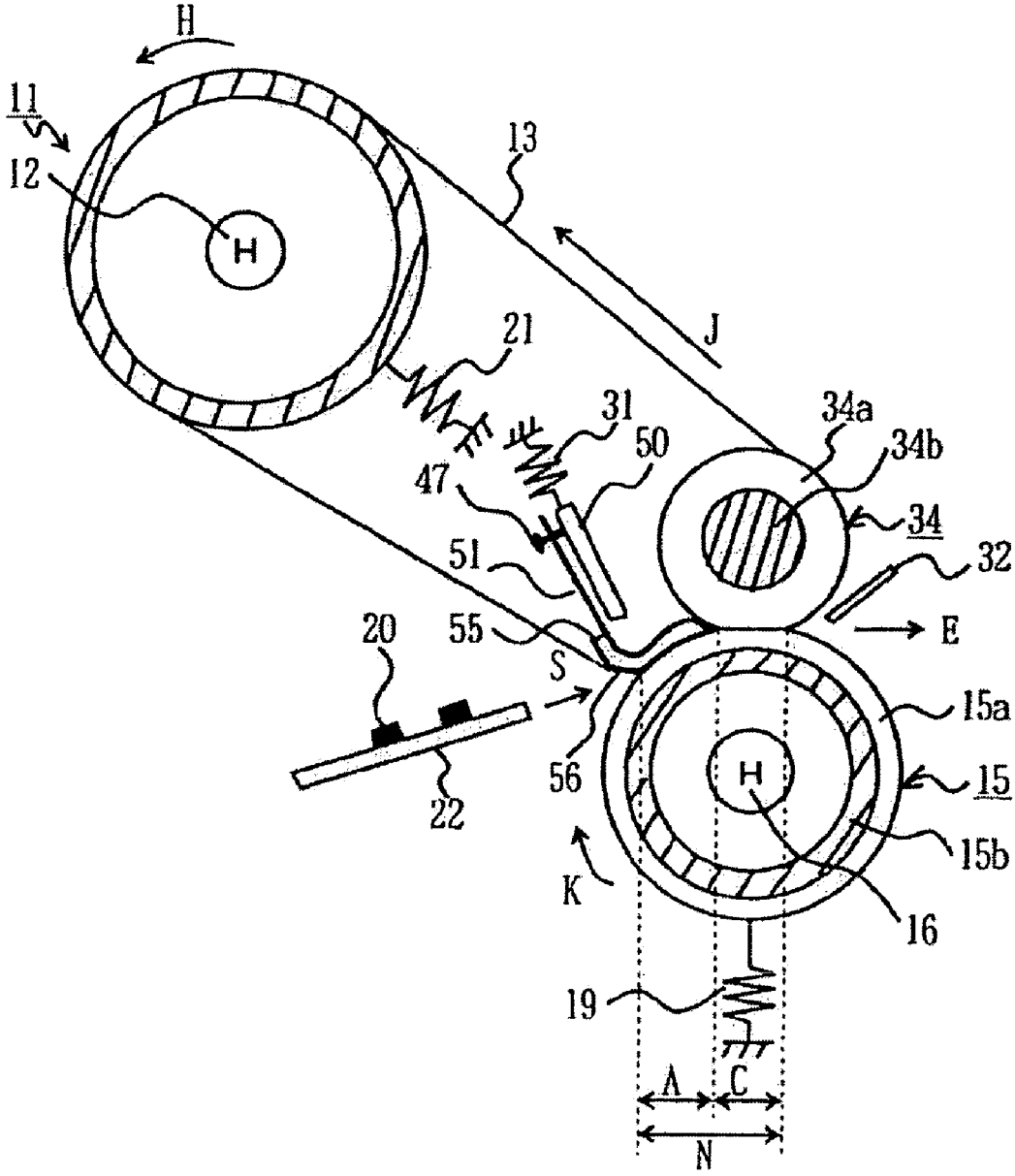
FIG. 19 is a cross-sectional view showing a fusing device of a belt type according to the eighth embodiment of this invention.
Figure 20:
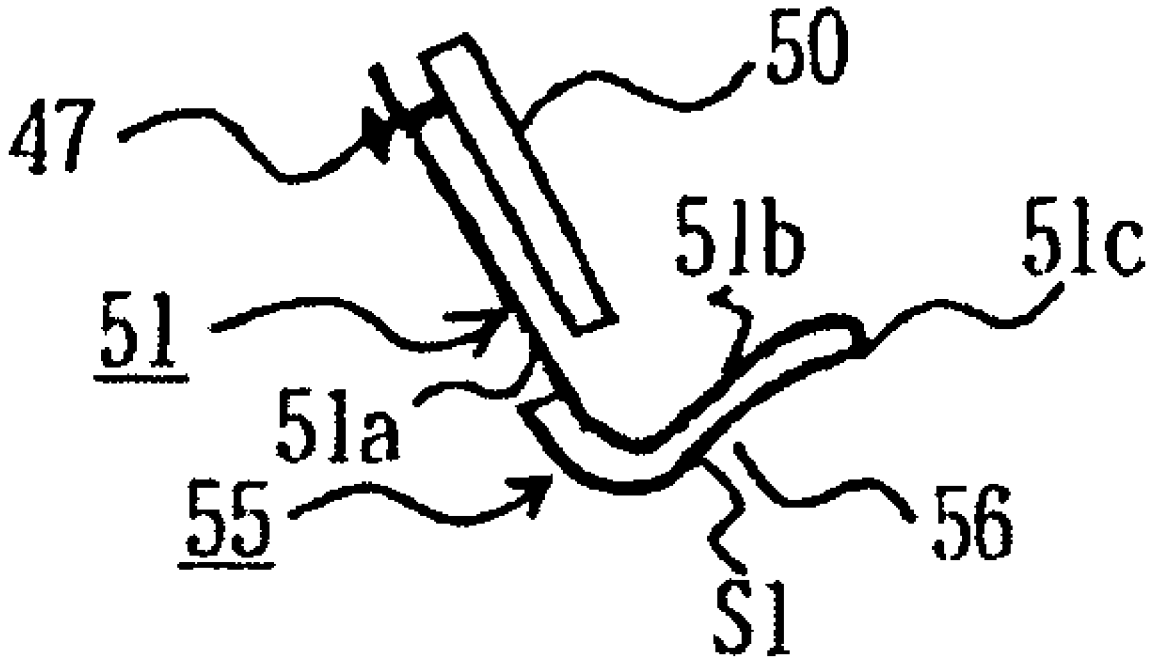
FIG. 20 is a cross-sectional view showing a leaf spring, a fusing pad, and a thermal insulating member according to the eighth embodiment of this invention.

FIG. 19 is a cross-sectional view showing a fusing device of a belt type according to the eighth embodiment of this invention, and FIG. 20 is a cross-sectional view showing a leaf spring, a fusing pad, and a thermal insulating member according to the eighth embodiment of this invention.

As shown in the drawings, the pressurized contact portion 51*b* of the leaf spring 51, defined as the pressurized contact member as well as the plate shaped member is equipped with an elastic member 55 serving as a resin member made of material having a good elasticity, such as, e.g., silicone rubber etc., in which a surface of the elastic member 55 is coated with a fluoric resin 56. In this case, since the elastic member 55 is made of elastic material, the flexibility of the pressurized contact area S1 of the elastic member 55 can be enhanced, thereby being easily deformed, so that it becomes easy not only to apply the equal pressure in the length direction of the sheet 22 serving as the recording medium but also easy to operate the control of, e.g., the bend in the length direction or the size of the leaf spring 51.

Accordingly, because the surface of the elastic member 55 is coated with the resin 56, the elastic member 55 can be prevented from coming in direct contact with the fusing belt 13. Therefore, frictional force between the elastic member 55 and the fusing belt 13 can be prevented from getting greater.

Furthermore, where the silicone rubber is used as the elastic member 55, the thermal insulation property increases, so that the duration of increasing the temperature of the fusing belt 13 can be shortened.

It is to be noted that this invention is not limited to the above described embodiments, but can be variously modified based on the purpose of this invention, and these modifications are not excluded from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A fusing device, comprising:

a roller;

a fusing belt that is heated and driven along a circumference of said roller;

a pressure member disposed outside said fusing belt and arranged in pressurized contact with said roller through said fusing belt; and a pushing member disposed inside said fusing belt and arranged on an upstream side of said roller relative to a driving direction of said fusing belt, and being in pressurized contact with said pressure member via said fusing belt;

wherein said fusing belt and said pressure member form a contact area through which a recording medium passes;

wherein a pushing force for causing said pushing member to be in pressurized contact with said pressure member is set less than a pushing force for causing said pressure member to be in pressurized contact with said roller; and wherein said pushing member has a pressurized contact portion disposed in front of an area at which said pressure member is in pressurized contact with said roller.

2. The fusing device according to claim 1, wherein said pushing member has a sliding surface in contact with said roller.

3. The fusing device according to claim 2, wherein said sliding surface includes a fluoric resin.

4. The fusing device according to claim 1, wherein said pushing member is composed of a plate shaped member having an elasticity.

5. The fusing device according to claim 1, wherein said pushing member has a projecting portion that projects toward said pressure member.

6. The fusing device according to claim 1, wherein said pushing member includes a resin member in contact with said fusing belt.

7. The fusing device according to claim 6, wherein said resin member has an elasticity.

8. The fusing device according to claim 7, wherein said resin member is composed of a material made of a silicone resin.

9. The fusing device according to claim 6, wherein a surface of said resin member is provided with a fluoric resin.

10. The fusing device according to claim 1, wherein a contact area between said roller and said pressure member is greater than a contact area between said pressure member and said pushing member.

11. A fusing device, comprising:

a roller a fusing belt that is heated and driven along a circumference of said roller;

a pressure member disposed outside said fusing belt and arranged in pressurized contact with said roller through said fusing belt; and a pushing member disposed inside said fusing belt and arranged on an upstream side of said roller relative to a driving direction of said fusing belt, and being in pressurized contact with said pressure member via said fusing belt;

wherein said fusing belt and said pressure member form a contact area through which a recording medium passes;

wherein a pushing force for causing said pushing member to be in pressurized contact with said pressure member is set less than a pushing force for causing said pressure member to be in pressurized contact with said roller; and wherein said pushing member is composed of a plate shaped member having an elasticity.

12. The fusing device according to claim 11, wherein said pushing member has a pressurized contact portion disposed in front of an area at which said pressure member is in pressurized contact with said roller.

13. The fusing device according to claim 11, wherein a contact area between said roller and said pressure member is greater than a contact area between said pressure member and said pushing member.

* * * * *